US005369816A

United States Patent [19]

Chen

[11] Patent Number: 5,369,816

[45] Date of Patent: Dec. 6, 1994

[54] AUTOMATIC WEIGHT-ACTIVATED TOILET FLUSHING APPARATUS

[76] Inventor: Chin-Jung Chen, No. 52, Lane 136, Sanmin Road, Taipei, Taiwan, Prov. of China

[21] Appl. No.: 171,226

[22] Filed: Dec. 21, 1993

[51] Int. Cl.[5] ..... E03D 5/04

[52] U.S. Cl. ..... 4/408; 4/405; 4/411

[58] Field of Search ..... 4/405, 408, 409, 410, 4/415, 363, 364, 335, 338, 436, 411, 412, 413

[56] References Cited

U.S. PATENT DOCUMENTS

| | | | |
|---|---|---|---|
| 90,453 | 5/1869 | Keane | 4/250 |
| 173,266 | 2/1876 | Calahan | 4/250 |
| 485,155 | 10/1892 | Herdegen | 4/364 |
| 1,051,123 | 1/1913 | Kreter et al. | 4/409 |
| 1,605,939 | 11/1926 | Hoas | 4/408 |
| 1,907,826 | 5/1933 | Kapp | 4/249 |
| 4,007,499 | 2/1977 | Lin | 4/249 |
| 4,225,985 | 10/1980 | Joshi et al. | 4/364 |
| 4,338,690 | 7/1982 | Hsieh et al. | 4/408 |
| 4,573,223 | 3/1986 | Schmidt | 4/408 |
| 5,067,180 | 11/1991 | Figeroid | 4/363 |

*Primary Examiner*—Henry J. Recla
*Assistant Examiner*—Charles R. Eloshway
*Attorney, Agent, or Firm*—Thomas M. Freiburger

[57] ABSTRACT

A automatic weight-activated toilet flushing apparatus, includes an automatic bounding device, a lifting/lowering device and a control box, wherein the bounding device is connected under a rear portion of a pad of a toilet bowl and connected to the lifting/lowering device so that when a user sits on the pad, the same is pressed down through a certain distance and the lifting/lowering device is simultaneously moved down, causing a slide block thereof to move downward. Meanwhile, a one-way control member is moved upward and biased by a pressing rod of the control box. When the user stands up, the slide block is moved back upward, making the one-way control member move downward to press down the pressing rod. When the pressing rod moves downward, a control rod of the control box is urged to move upward and open a valve of a water tank so as to discharge the water contained therein.

2 Claims, 8 Drawing Sheets

AUTOMATIC WEIGHT-ACTIVATED TOILET FLUSHING APPARATUS

BACKGROUND OF THE INVENTION

The present invention is a flushing apparatus for the toilet or more precisely automatic weight-activated toilet flushing apparatus.

Conventional toilet flushing device includes a water tank with a pressing lever and a pulling lever, wherein after using the toilet, a user presses down the pressing lever to lift the pulling lever upward so as to pull up a valve from a water outlet in the water tank and discharge the water for flushing the toilet bowl. However, after a period of use, the pressing lever is liable to become loose from the pulling lever. This causes that the valve fail to effectively block the water outlet of the water tank. As a result, the water continuously leaks from the outlet and is wasted.

Moreover, it is often seen that the toilet bowl is not flushed by a previous user, especially in a public place. This is because the user is unwilling to or forgets to press the pressing lever.

In addition, each time a user flushes the toilet bowl, a fixed considerably large amount of water is discharged from the water tank. This causes water waste when it is unnecessary to use such a large amount of water to flush the toilet bowl. Therefore, it is necessary to provide an automatic toilet flushing device which automatically flushes the toilet bowl each time and which is able to discharge a reduced amount of water to flush the toilet bowl.

SUMMARY OF THE INVENTION

It is therefore a primary object of the present invention to provide an automatic toilet flushing apparatus which automatically flushes the toilet bowl each time a user finishes using the toilet bowl.

It is a further object of the present invention to provide the above toilet flushing apparatus which is also equipped with an auxiliary pressing device for flushing the toilet bowl in a pressing manner.

It is still a further object of the present invention to provide the above toilet flushing apparatus in which the water tank is divided into two compartments, where the water in only one of the compartments is discharged to flush the toilet bowl when the seat is lifted when a male user wants to flush away urine or a user wishes to clean up the toilet bowl, thus saving water.

BRIEF DESCRIPTION OF THE DRAWINGS

The structural feature and advantages of the present invention, and the technical means adopted to achieve the present invention can be best understood through the following detailed description of the preferred embodiment and the accompanying drawings.

DETAILED DESCRIPTION OF THE PREFERRED EMBODIMENT

Figure 1:
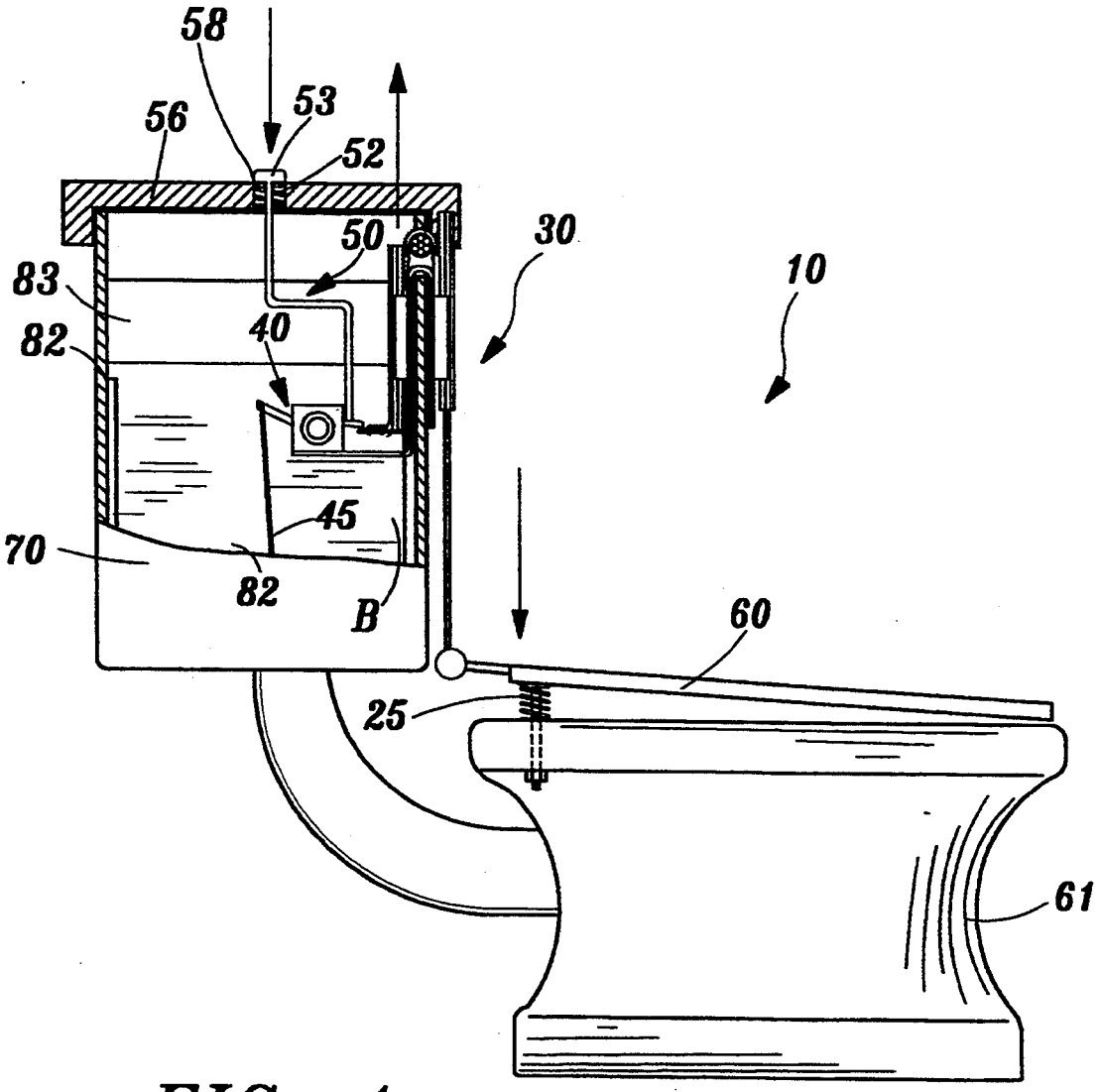
FIG. 1 is a partially sectional view of the present invention.
Figure 2:
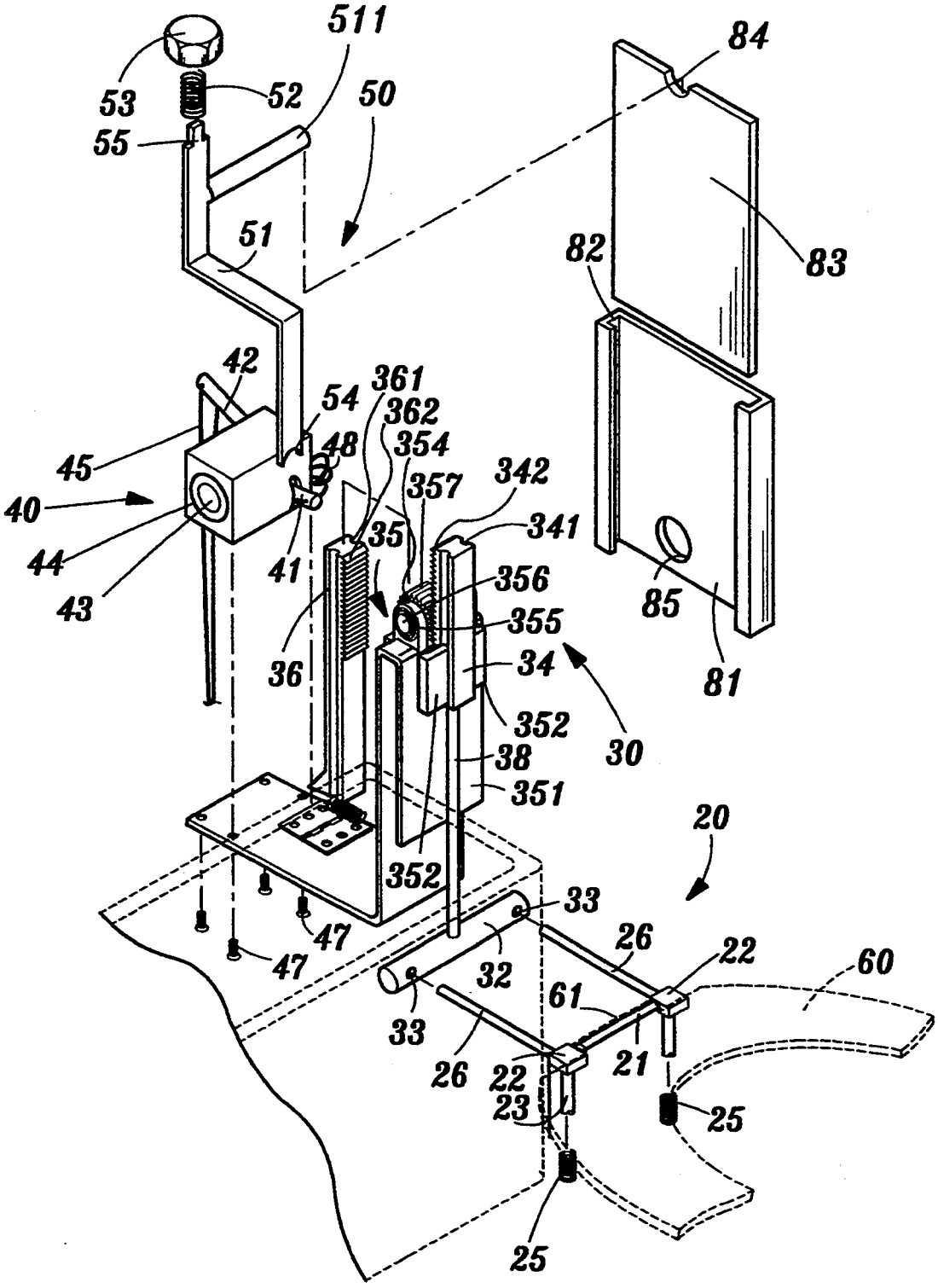
FIG. 2 is perspective exploded view.
Figure 3:
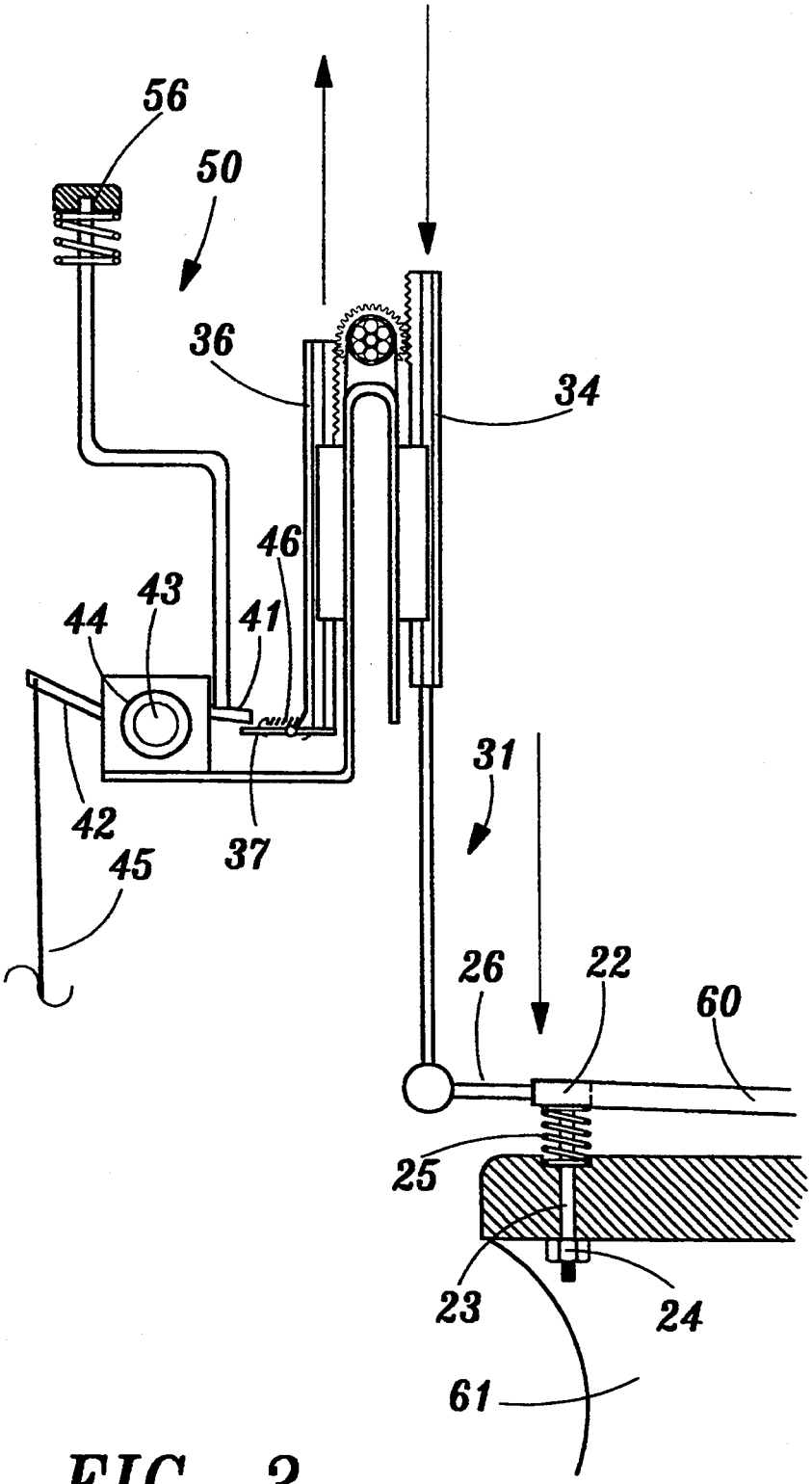
FIG. 3 is a sectional view before use.

Please refer to FIGS. 1, 2 and 3. The toilet flushing apparatus 10 includes an automatic bounding device 20, a lifting/lowering device 30, a control box 40 and an auxiliary pressing device 50. The bounding device 20 includes a connecting lever 21, two fixed blocks 22 positioned at two ends of the connecting lever 21, two guiding rods 23 connected respectively under the fixing blocks 22 and two driving pins 26 extending rearward from the fixing blocks 22. The guiding rods 23 penetrate through a rear portion of a pad 60 of a toilet bowl 61 to be secured by screws 24. Springs 25 are fitted on the guiding rods 23, therebetween.

The lifting/lowering device 30 includes a T-shaped member 31, a first slide block 34, a shaped support member 35, a second slide block 36 and a one-way control member 37, wherein the T-shaped member 31 has a short rod 32 formed with fixing holes 33 in which the driving pins 26 of the bounding device 20 are inserted, and a long rod 38 on which the first slide block 34 is fixed. The first slide block 34 is formed with a rear rack portion 342 and two lateral guiding grooves 341. The shaped support member 35 has a hook portion 351 suitable to hang over a wall of a water tank 70. The second slide block 36 is formed with a front rack portion 362 and two lateral guiding grooves 361. Two pairs of guiding rails 352, are positioned on two opposite faces of the hook portion 351 to respectively engage with the guiding grooves 341, 361 of the first and second slide blocks 34, 36. Two shaft supports 354 are positioned on a horizontal face of the hook portion 351 and two bearings 355 are fitted in the shaft supports 354. A shaft rod 356 is fitted in the bearings 355 and a sleeve-like gear 357 is fitted on the shaft rod 356. The rack portions 342, 362 of the first and second slide blocks 34, 36 are both engaged with the sleeve-like gear 357. The one-way control member 37 is positioned at a lower end of the second slide block 36 and hooked by a resilient member 46 for restoring the control member 37 to its home position.

The control box 40 is secured on the shaped support member 35 by screws 47, having an inner lever member 43 fitted in a bearing 44. A pressing rod 41 and a control rod 42 respectively extend forward and rearward from the lever member 43. A chain member 45 is fixed on the control rod 42 for control of the opening/closing of a valve of the water tank 70. This pertains to prior art and will not be further discussed hereinafter.

Figure 4:
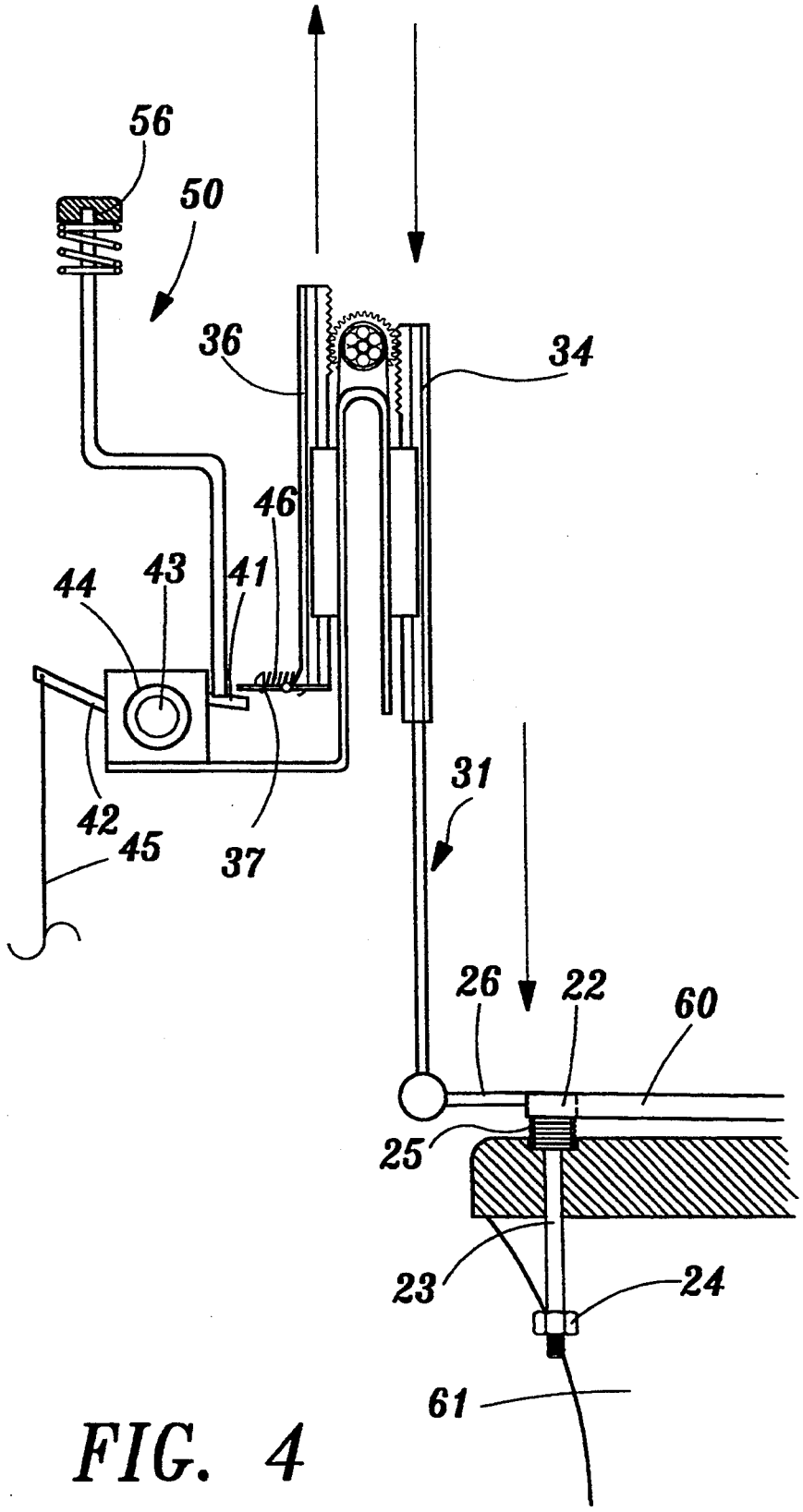
FIG. 4 is a sectional view after use.
Figure 5:
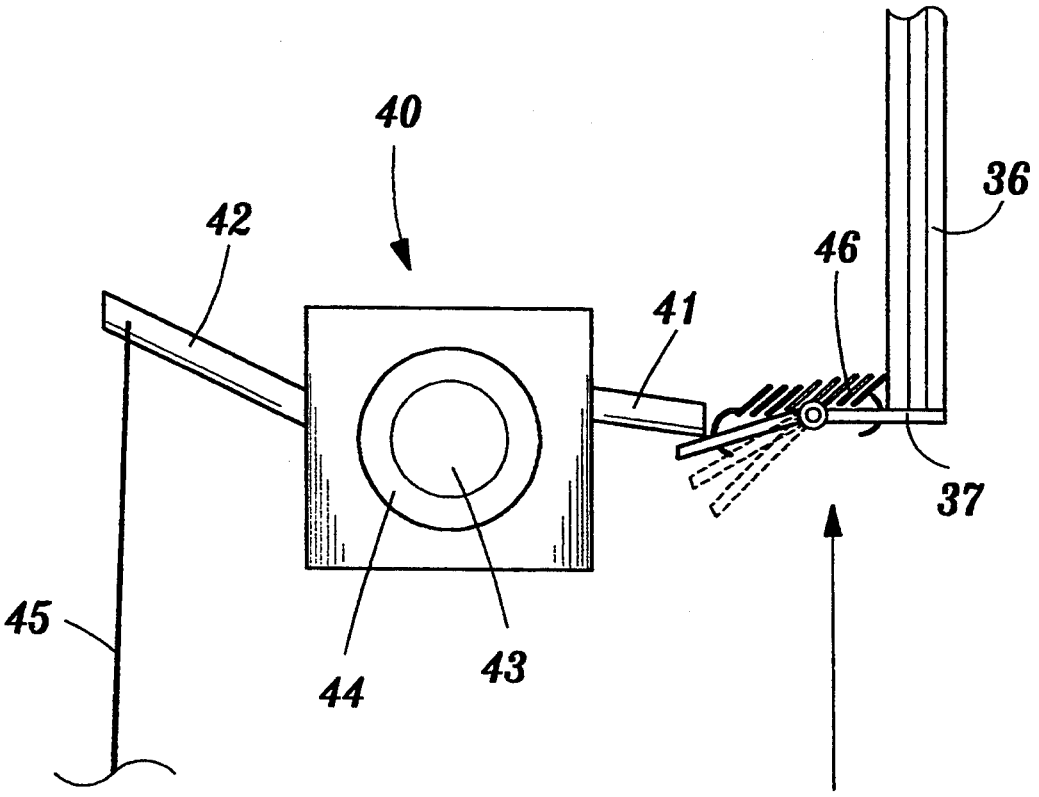
FIG. 5 shows the interaction between the pressing rod of the control box and the one-way control member of the present invention.

When a user sits on the pad 60, the bounding device 30 is pressed down through a predetermined distance. Meanwhile, the first slide block 34 is driven to move downward. Simultaneously, the sleeve-like gear 357 is rotated clockwise, driving the second slide block 36 to move upward as shown by straight arrows of FIGS. 3 and 4. When the second slide block 36 moves upward, the control member 37 is moved upward and biased by the pressing rod 41 as shown in FIG. 5.

Figure 6:
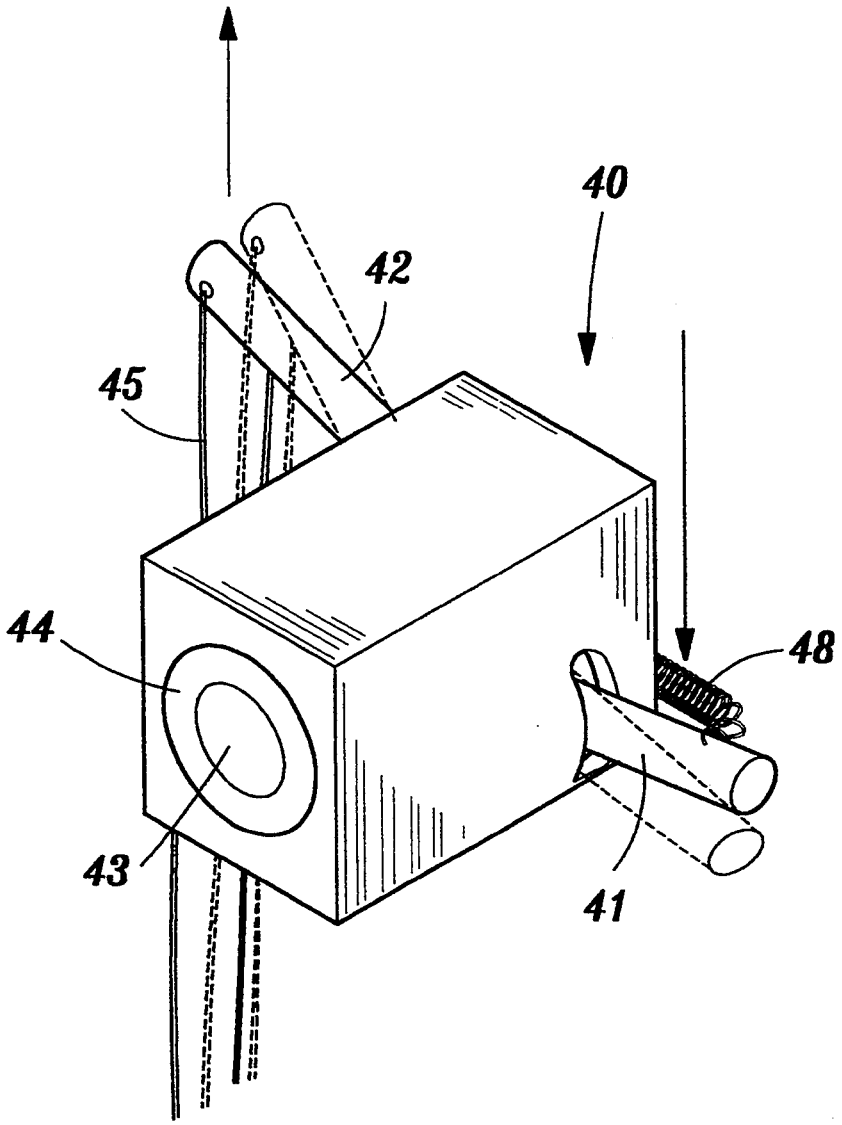
FIG. 6 is a perspective view of the control box, wherein the phantom lines show the positions of the pressing rod and control rod in a pressed state.

After the user uses the toilet and when the user stands up, the bounding device 30 bounds upward and the first slide block 34 is driven to move upward. Simultaneously, the sleeve-like gear 357 is rotated counterclockwise, driving the second slide block 36 to move downward. When the second slide block 36 moves downward, the control member 37 is moved downward to press the pressing rod 41 and makes the same move downward as shown in FIG. 6. When the pressing rod 41 moves downward, the control rod 42 and the chain member 45 move upward to open the valve of the water tank 70, allow the water therein to discharge outside.

Figure 6A:
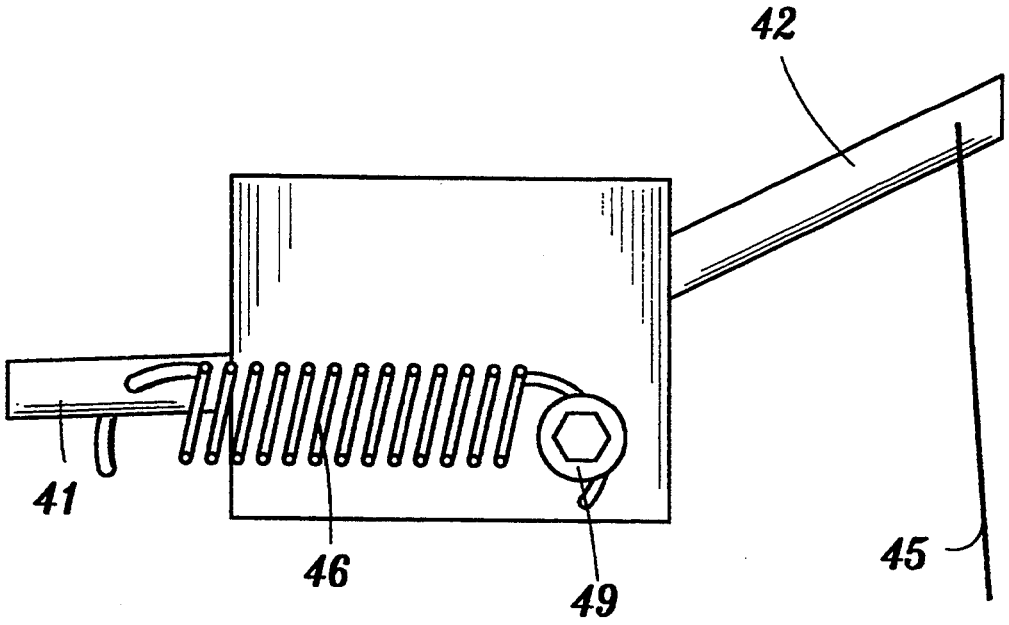
FIG. 6A is a side sectional view of the control box.
Figure 7:
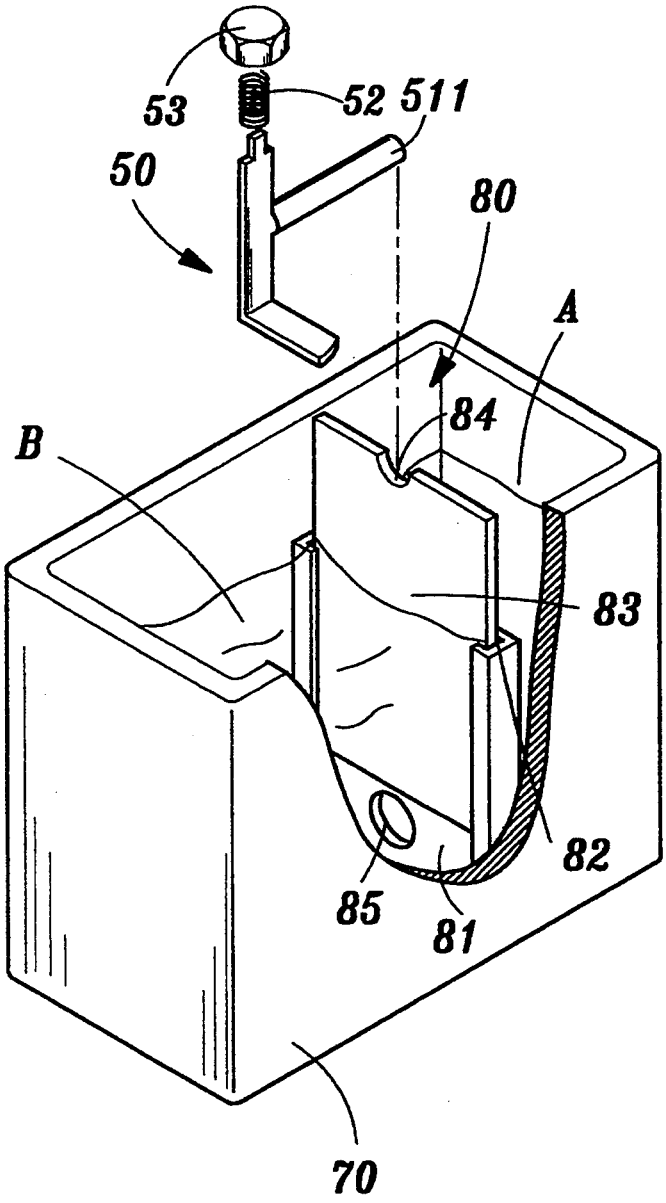
FIG. 7 shows the water-saving device positioned in the water tank.

According to FIGS. 6 and 6A, after the pressing rod 41 moves downward through a certain distance, a resilient member 48 will restore the pressing rod 41 to its home position.

Please refer to FIGS. 1 to 4. The auxiliary pressing device 50 includes a pressing button 53, a pressing lever 511 and a shaped driving lever 51 formed with a top projection 55 on which the pressing button 53 is fitted. A spring 52 is fitted on the top projection 55 under the pressing button 53. The shaped driving lever 51 has an arch recessed lower end 54 suitable to abut against the pressing rod 41, whereby the user presses the button 53, the shaped driving lever 51 is moved downward to press down the pressing rod 41 and thus urges the controlling rod 42 to move upward so as to open the valve of the water tank 70 and discharge the water in the water tank 70.

Please refer to FIGS. 1 to 7. A water-saving device is positioned in the water tank 70 to separate the same into a large and a small compartments B and A. The water-saving device 80 includes a separating board 81 and a movable board 83. The separating board 81 is fixed on an inner wall of the water tank 70 and formed with an opening 85 at a predetermined position. The separating board 81 is also formed with two lateral guiding channels 82 and the movable board 83 is movably positioned within the guiding channels 82 and formed with an upper recess 84. When pressing down the pressing button 53, the pressing lever 511 together with the pressing rod 41 is moved downward, abutting against the recess 84 and pressing down the movable board 83 to block the opening 85 of the separating board 81 and preventing the water from flowing out of the small compartment A. On the other hand, when the pressing rod 41 moves downward, the control rod 42 will open the valve of the water tank 70 and allow the water in the large compartment B to flow out for flushing the toilet bowl. As a consequence, the water in the small compartment A is saved.

After the water in the compartment B is discharged, the movable board 83 will descend due to reduction of buoyancy. Thereafter, the water tank 70 is re-filled up with water and the movable board 83 ascends due to the buoyancy and open the opening 85 to communicate the large and small compartments B and A. The above arrangement permits a male user to flush the urine with the water in only the compartment B and save the water in the compartment A.

When the user sits on the pad 60, the opening 85 is opened. Therefore, when the user stands up after using the toilet bowl, the water in both the compartments A and B will discharge for flushing the toilet bowl.

It is to be understood that the above description and drawings are only used for illustrating one embodiment of the present invention, and not intended to limit its scope. Any variation and derivation from the above description and drawings should be included in the scope of the present invention.

What is claimed is:

1. An automatic weight-activated toilet flushing apparatus, comprised of an automatic bounding device, a lifting and lowering device, a control box and an auxiliary pressing device, wherein:

said bounding device includes a connecting lever, two fixed blocks positioned at opposite ends of said connecting lever, two guiding rods connected respectively to an underside of said fixed blocks and two driving pins connected to and extending rearwardly from, said fixed blocks, said guiding rods adapted for penetrating through a rear portion of a pad of a toilet bowl and for securing to said bowl, springs being fitted on said guiding rods between said fixed blocks and said toilet bowl so as to provide a space therebetween;

said lifting and lowering device includes a T-shaped member, a first slide block, a support member, a second slide block and a one-way control member, said T-shaped member comprising a short rod formed with fixed holes in which said driving pins of said bounding device are inserted, and a long rod connected thereto on which said first slide block is fixed, said first slide block being formed with a rearwardly facing rack portion and two lateral guiding grooves, said support member having a hook portion suitable for hanging over a wall of a toilet water tank, said second slide block being formed with a forwardly facing rack portion and two lateral guiding grooves, two pairs of guiding rails being positioned on two opposite faces of said hook portion to respectively engage with said guiding grooves of said first and second slide blocks, two shaft supports being positioned on a horizontal face of said hook portion and two bearings being fitted in said shaft supports, a shaft rod being fitted in said bearings and a sleeve-like gear being fitted on said shaft rod, said rack portions of said first and second slide blocks being both engaged with the sleeve-like gear, said one-way control member being positioned at a lower end of said second slide block and biased by a resilient member for restoring said control member to its original position;

said control box is secured on said support member by screws, and has an inner lever member fitted in a bearing, a pressing rod and a control rod respectively extending forwardly and rearwardly from said lever member, a chain member being fixed on said control rod for controlling opening and closing movements of a flush valve of said water tank, a resilient member being connected to said pressing rod for restoring the same to its original position; and said auxiliary pressing device includes a pressing button, a driving lever responsive to said pressing button formed with a top projection on which said pressing button is fitted, a pressing lever extending laterally from said driving lever, a spring being fitted on said top projection under said pressing button, said driving lever having an arch recessed lower end adapted to engage said pressing rod; whereby, when a weight is placed on said pad, said bounding device moves said first sliding block downwardly via said T-shaped member, moving said second sliding block upwardly via said sleeve-like gear, causing said one way control member to engage said pressing rod, thus causing said control rod and chain member to open said flush valve; and whereby, said auxiliary pressing device is operable to independently actuate said pressing rod to open said flush valve, via said control rod and chain member.

2. A toilet flushing apparatus as claimed in claim 1, which further comprises a water-saving device positioned in said water tank to separate the same into a large and a small compartment, said water-saving device including a separating board and a movable board, said separating board adapted to be fixed on an inner wall of said water tank and formed with an opening located at a predetermined position, said separating board being also formed with two lateral guiding channels and said movable board being movably positioned within said guiding channels and formed with an upper recess, whereby when pressing down said pressing button, said pressing lever together with said driving lever is moved downward, abutting against said recess and pressing down said movable board to block said opening of said separating board and preventing water from flowing out of said small compartment into said large compartment, said driving lever further engaging said pressing rod to actuate said control rod and said chain member to open said flush valve of said water tank and permit water in said large compartment to flow out for flushing the toilet bowl, thus conserving water in said small compartment.

* * * * *